US006672973B1

(12) United States Patent
Muntz

(10) Patent No.: US 6,672,973 B1
(45) Date of Patent: Jan. 6, 2004

(54) GOLFER TRAINING DEVICE

(75) Inventor: Michael Cornelis Muntz, Mosman Park (AU)

(73) Assignee: Stellar Promotions Pty Ltd (AU)

( * ) Notice: Subject to any disclaimer, the term of this patent is extended or adjusted under 35 U.S.C. 154(b) by 0 days.

(21) Appl. No.: 09/830,853

(22) PCT Filed: Oct. 29, 1999

(86) PCT No.: PCT/AU99/00942

§ 371 (c)(1),
(2), (4) Date: May 2, 2001

(87) PCT Pub. No.: WO00/25872

PCT Pub. Date: May 11, 2000

(30) Foreign Application Priority Data

Nov. 2, 1998 (AU) ..... PP6835
Nov. 16, 1998 (AU) ..... PP7125

(51) Int. Cl.[7] ..... A63B 69/36
(52) U.S. Cl. ..... 473/217; 602/4
(58) Field of Search ..... 473/217, 207, 473/208, 212, 215, 218, 201, 266, 269, 270, 271, 62, 63; 123/869, 875, 876, 882; 602/4; 482/124; 606/53

(56) References Cited

U.S. PATENT DOCUMENTS 1,015,054 A * 1/1912 McBride ..... 2/313
3,799,158 A * 3/1974 Gardner
3,900,199 A * 8/1975 McGonagle
4,014,327 A * 3/1977 Spiro ..... 473/213
4,088,326 A * 5/1978 Bifulco
4,294,238 A * 10/1981 Woodford ..... 2/22
4,359,221 A * 11/1982 Taylor ..... 473/212
5,014,692 A * 5/1991 Rhoades ..... 128/882
5,188,365 A * 2/1993 Picard
5,256,119 A * 10/1993 Tudor ..... 128/882
5,291,904 A * 3/1994 Walker ..... 128/882
5,435,563 A * 7/1995 Salvatore
5,704,856 A * 1/1998 Morse
5,779,655 A * 7/1998 Holden ..... 128/882
5,800,371 A * 9/1998 Winn
5,843,010 A * 12/1998 Bodmer ..... 128/882
6,129,638 A * 10/2000 Davis
6,203,453 B1 * 3/2001 Coddens
6,428,495 B1 * 8/2002 Lynott ..... 128/875

FOREIGN PATENT DOCUMENTS

JP 08-336628 12/1996
WO WO 93/06898 4/1993

* cited by examiner

*Primary Examiner*—Paul T. Sewell
*Assistant Examiner*—Nini F. Legesse
(74) *Attorney, Agent, or Firm*—Larson & Taylor, PLC

(57) ABSTRACT

A golfer training device (50) is disclosed. The device (50) includes a first strap (52) which is fastened around a golfer's leg above the knee (36). A second strap (14) is fastened just above the ankle (38) and below the calf muscle of the same leg. A third strap (16) is joined to and interconnects both the first and second straps (52, 14), and runs vertically up behind the leg to a type of quick-release adjusting clasp (70). All three straps are made of a substantially inextensible, flexible material. The length of the third strap (16) can be shortened by pulling on an adjusting strap (30), thereby causing the leg to bend at the knee (36). A tube (64) behind the golfer's knee (36) ensures that there is also a horizontal pull on strap (52), which helps to securely hold strap (52) in place and prevent it from slipping down the leg. Once the golfer sets the desired amount of flex in his knee (36), he will be able to practice his golf swings secure in the knowledge that his knee will remain flexed throughout the full swing.

8 Claims, 6 Drawing Sheets

GOLFER TRAINING DEVICE

This application claims the benefit of the national stage of PCT/AU99/00942, filed Oct. 29, 1999.

FIELD OF THE INVENTION

The present invention relates to a golfer training device for training a golfer to maintain a desired flex in one leg whilst executing a full golf swing.

BACKGROUND TO THE INVENTION

It is well established in golf instruction manuals and videos that the knee furtherest from the target towards which the golfer is aiming, hereinafter called the back knee, should remain in the same flexed position during the swing as it was at address. There is a tendency for many golfers however to want to straighten their back knee, especially during the back swing portion of the swing, which makes it very difficult for them to make consistently good contact with the ball during the downswing.

The present invention seeks to overcome this particular difficulty by providing a means whereby a golfer practicing shots on a golf driving range can artificially maintain the desired flex in his or her back knee. The device, when fitted to a golfer's leg, will help the leg muscles acquire the necessary muscle memory to enable the golfer to eventually keep the back knee flexed while swinging a club during an actual game of golf when artificial aids are not permitted.

Australian Patent Application No. 26737/92, which is the Australian National Phase of PCT/GB92/01838 (WO 93/06898), discloses a golfer practice device which also seeks to overcome this problem. AU 26737/92 discloses a device which is fitted to the golfer's knee (right knee for right-handed golfers and left knee for left-handed golfers) and which comprises a panel of flexible material such as fabric or leather, having embedded within it a stay in the form of a metal rod or strip which is bent in a central region to define a desired angle. This angle is related to the natural set angle of the leg at the addressed position on the golfer. The angle can be varied by bending the stay to suit the golfer, but once the device is fixed in position the angle is meant to be maintained. The panel is provided with three straps for fastening the device to the knee, two of which straps pass around the leg directly above and directly below the knee respectively, and the third of which passes around the leg directly behind the knee.

There are several difficulties with the device of AU 26737/92. Firstly, in order to correctly hold the knee at the desired angle it is essential that all three straps are tightly bound around the leg so that the knee is effectively immobilised by the stay. Apart from being difficult to achieve over the golfer's trousers, this is also quite uncomfortable and has the tendency to restrict circulation through the knee. Secondly, the golfer's natural tendency to straighten the leg during the backswing causes the metal stay to dig into the golfer's leg above and below the knee, causing further discomfort and pain. Thirdly, although the stay is meant to retain its angle, the natural resilience of the metal will allow a degree of bending in use which defeats the purpose of the device. For the above reasons this type of prior art device has not proven to be very popular in practice.

SUMMARY OF THE INVENTION

The present invention was developed with a view to providing a golfer training device which works effectively to maintain a desired flex in one leg of the golfer whilst executing a full golf swing.

Throughout this specification the term "comprising" is used inclusively, in the sense that there may be other features and/or steps included in the invention not expressly defined or comprehended in the features or steps subsequently defined or described. What such other features and/or steps may include will be apparent from the specification read as a whole.

According to the present invention there is provided a golfer training device for training a golfer to maintain a desired flex in one leg whilst swinging a golf club, the device comprising:

- a first strap made of substantially inextensible, flexible material and adapted to be fitted above the knee of said one leg;
- a second strap made of substantially inextensible, flexible material and adapted to be fitted below the calf muscle of said one leg; and,
- a third adjustable strap made of substantially inextensible, flexible material joined to and interconnecting said first and second straps and adapted to extend vertically behind the knee of said one leg whereby, in use, the length of said third strap can be shortened to cause the knee to flex and remain flexed until the strap is lengthened again.

Preferably said first, second and third straps are made from a non-stretch webbing material and may be tightened and held fast about the leg by means of hook and loop fastener material. Advantageously the first and second straps are provided with a strip of non-slip material on an inner surface. thereof adapted to inhibit slipping of the straps when fastened about the leg.

Preferably said third strap is provided in two elongate portions, each portion having one end fixed to a respective one of the first and second straps and the respective second ends of the portions being joined by a clasp. Preferably the other end of one of said portions of the third strap passes through the clasp and hangs free, whereby the length of said third strap can be shortened by pulling on said free-hanging other end to tension said third strap. Typically said clasp is of the quick-release type having a releasing means for releasing the tension on said third strap when said releasing means is activated.

Preferably the device further comprises a securing means arranged to rest against the back of the golfer's knee with said third strap extending over said securing means, wherein when said third strap is shortened, a degree of horizontal pull is applied to said first strap to help hold said first strap securely in place. Preferably said securing means is of cylindrical shape and is attached to said first strap.

BRIEF DESCRIPTION OF THE DRAWINGS

In order to facilitate a more comprehensive understanding of the nature of the invention several embodiments of the golfer training device will now be described in detail, by way of example only, with reference to the accompanying drawings, in which.

DETAILED DESCRIPTION OF PREFERRED EMBODIMENTS

Figure 1:
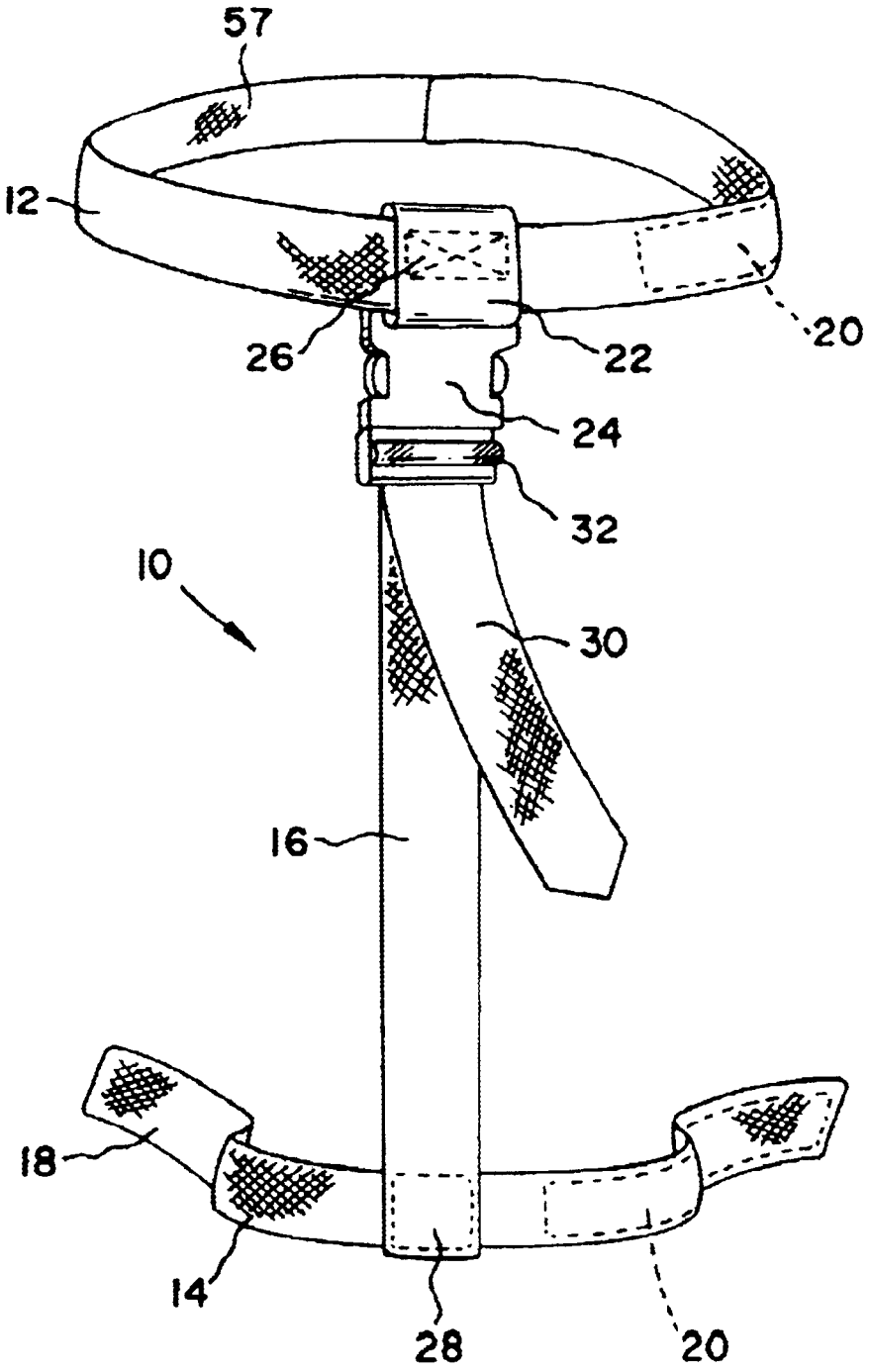
FIG. 1 illustrates a first embodiment of a golfer training device in accordance with the present invention.

In referring to FIG. 1 it can be seen that the golfer training device 10 according to a first embodiment of the present invention comprises first, second and third straps 12, 14 and 16 made of strong, non-stretch webbing material similar to that used in the manufacture of car-seat belts. The first strap 12 is adapted to be fitted just above the golfer's back knee, the second strap 14 is adapted to be fitted just below the calf muscle of the same leg and the third adjustable strap 16 is adapted to extend vertically behind the back knee as can be seen most clearly in FIGS. 2 and 3. The third strap 16 is joined to and interconnects the first and second straps 12, 14. Both the first and second straps 12, 14 are provided with respective strips 18, 20 of hook and loop fastening material, such as that sold under the registered trade mark Velcro, to enable the golfer to fasten the straps tightly around the leg.

In this embodiment, the third strap 16 includes a loop 22 holding a suitable metal or plastic two piece quick-release clasp 24, stitched to the first strap 12 at 26. One end of a second portion of the third strap 16 is connected to the second strap 14 by means of stitching at 28, and the other end 30, hereinafter referred to as the adjusting strap 30, is fed over and under a male piece of the clasp 24 at 32 so that it hangs free.

Figure 2:
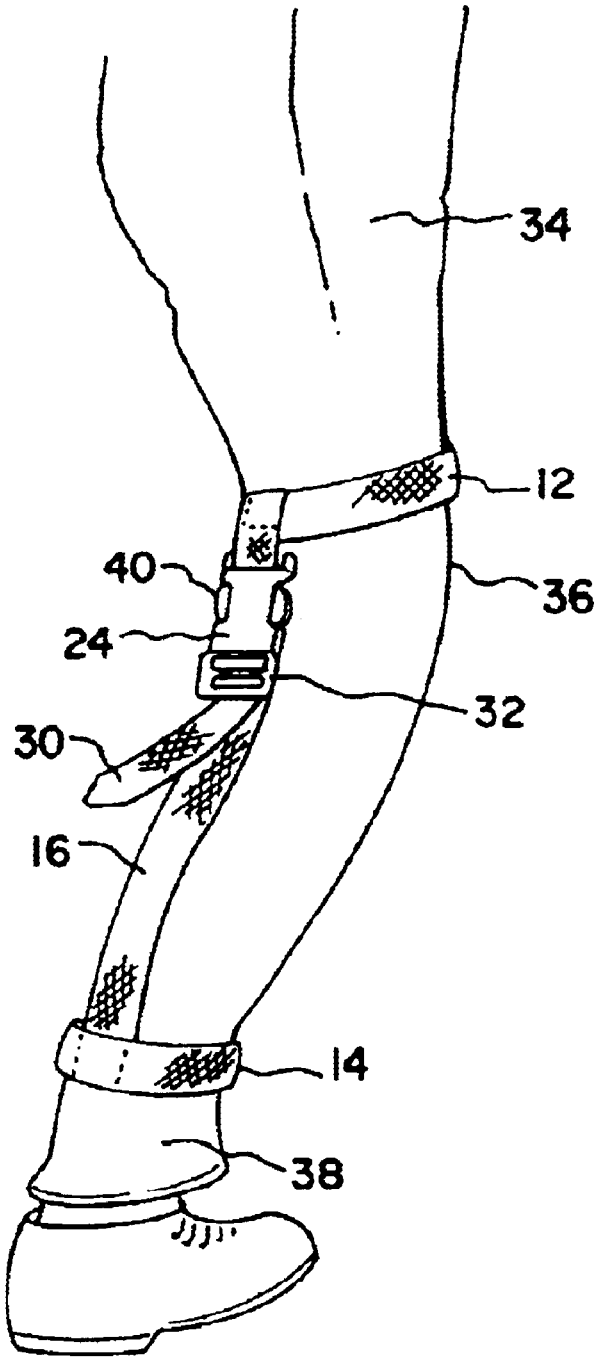
FIG. 2 shows a rear close-up view of a golfer's right leg with the golfer training device of FIG. 1 fitted thereto.

FIG. 2 illustrates the manner in which the device 10 is fitted to the right leg 34 of a right-handed golfer. It can be seen that the first strap 12 is fastened snugly just above the knee 36 in a generally horizontal position, and the second strap 14 is fitted horizontally just above the ankle 38 and below the calf muscle of the same leg. Both of these straps may be tightened and held fast by suitable fastening means, such as the hook and loop fastening material mentioned above. The third strap 16 runs vertically down the back of the leg behind the knee 36. By pulling downwards on the adjusting strap 30 the length of strap 16 is shortened, which in turn forces the leg to bend at the knee 36. The golfer is thereby able to adjust the angle or flex he wishes his knee to maintain during his golf swing, because the length of strap 16 determines the degree to which his knee bends. Once the flex has been set, the golfer can proceed to make a full swing of the golf club, secure in the knowledge that his right knee will not straighten, but remain correctly flexed throughout the entire swing.

At the end of the practice session, the golfer can activate the quick-release clasp 24 by pressing on buttons 40 which releases the male piece 32 to which strap 16 is connected from the female piece of the clasp. Alternatively, the golfer can pull upwards on the adjusting strap 30 which releases the grip of piece 32 on the strap allowing strap 16 to lengthen as he straightens his leg. One advantage of using this type of two-piece quick-release clasp 24 is that the next time the golfer wishes to use the device, he does not have to adjust the length of strap 16 to create the required flex in his knee. The male piece 32 of the clasp is simply reinserted in the female piece of the clasp 24 and the strap 16 remains pre-set at the required length.

Figure 3:
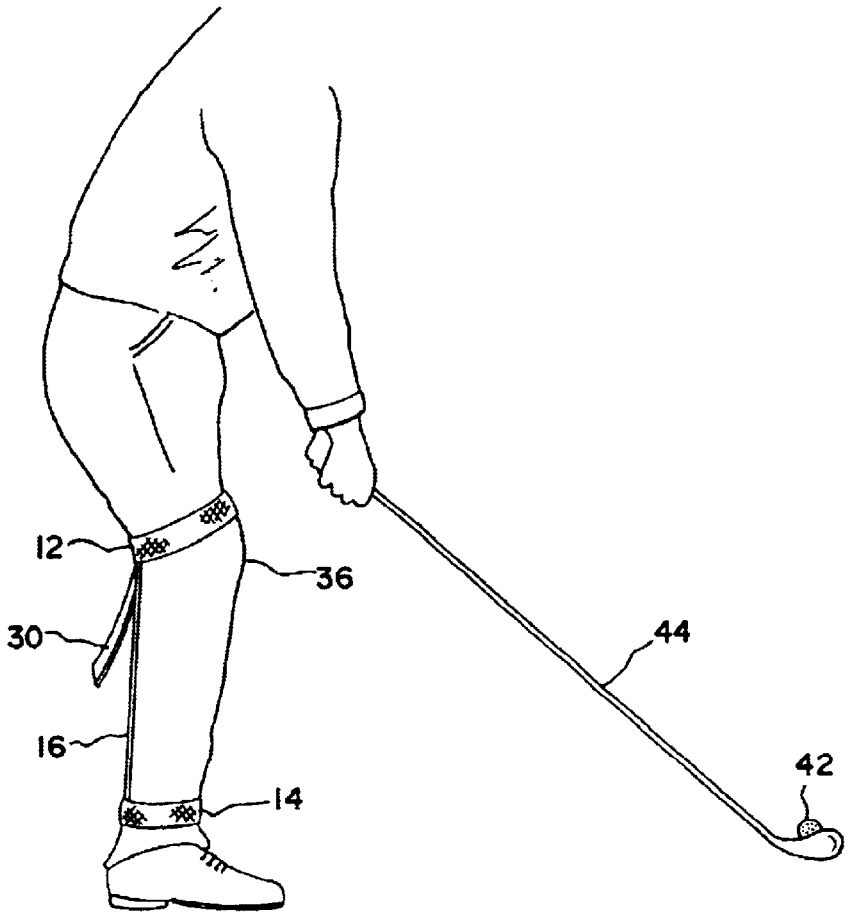
FIG. 3 shows a view of the lower half of a golfer addressing a golf ball with a golf club, with the golfer training device of FIG. 1 fitted to the right leg.

FIG. 3 illustrates the golfer with the golfer training device 10 fitted to his right leg, addressing a golf ball 42 with a golf club 44, ready to make a swing and strike the ball. The length of the third strap 16 is adjusted by pulling on the adjusting strap 30 to create the desired flex in the knee 36. In this way, the golfer ensures his right knee will not straighten when making a golf swing, giving him a much greater chance of consistently hitting good shots.

Figure 4:
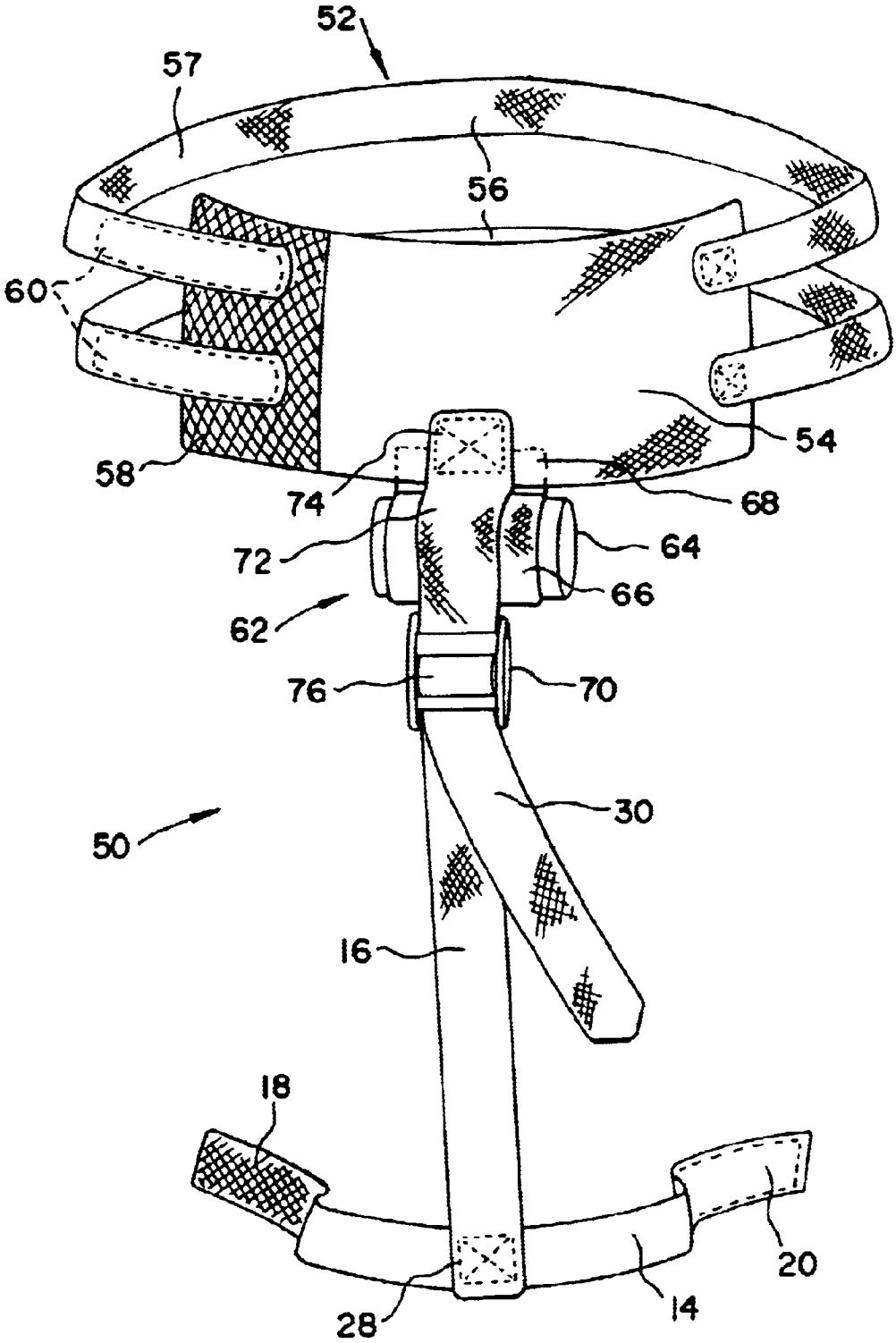
FIG. 4 illustrates a second embodiment of a golfer training device in accordance with the present invention.
Figure 5:
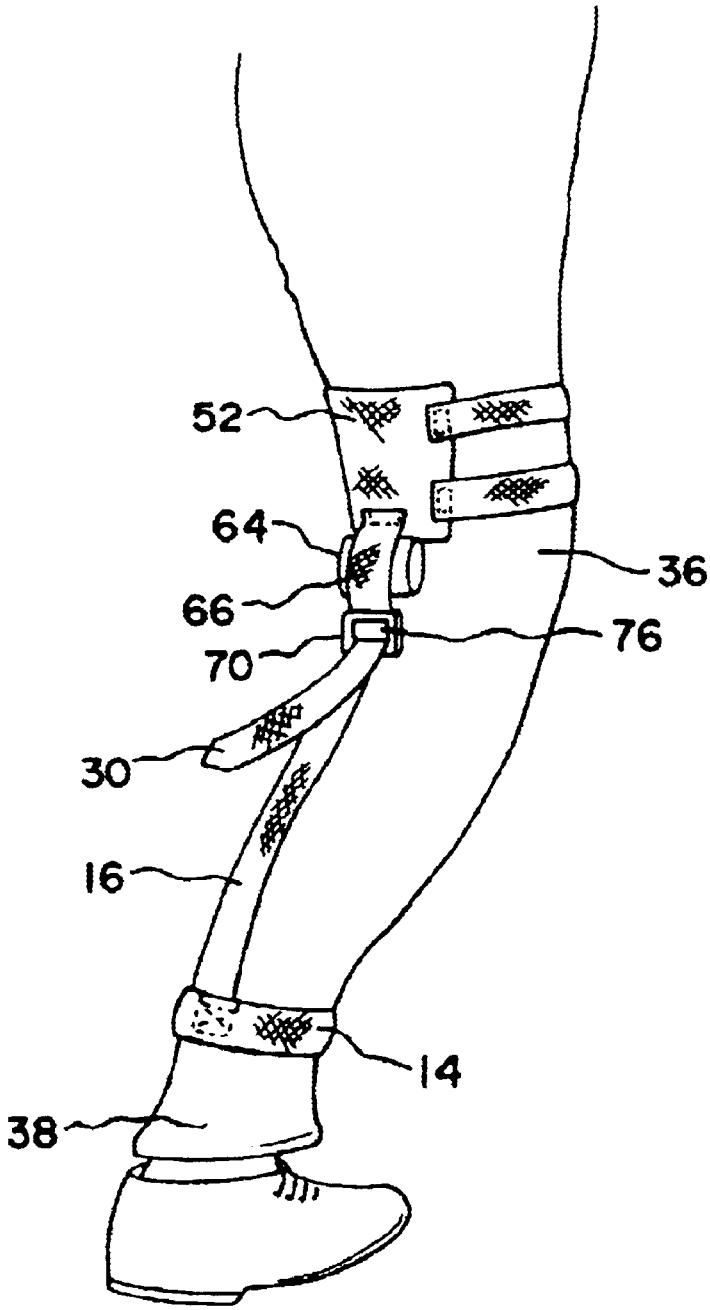
FIG. 5 shows a rear close-up view of a golfer's right leg with the golfer training device of FIG. 4 fitted thereto; and, FIG. 6 shows a view of the lower half of a golfer addressing a golf ball with a golf club, with the golfer training device of FIG. 4 fitted to the right leg.
Figure 6:
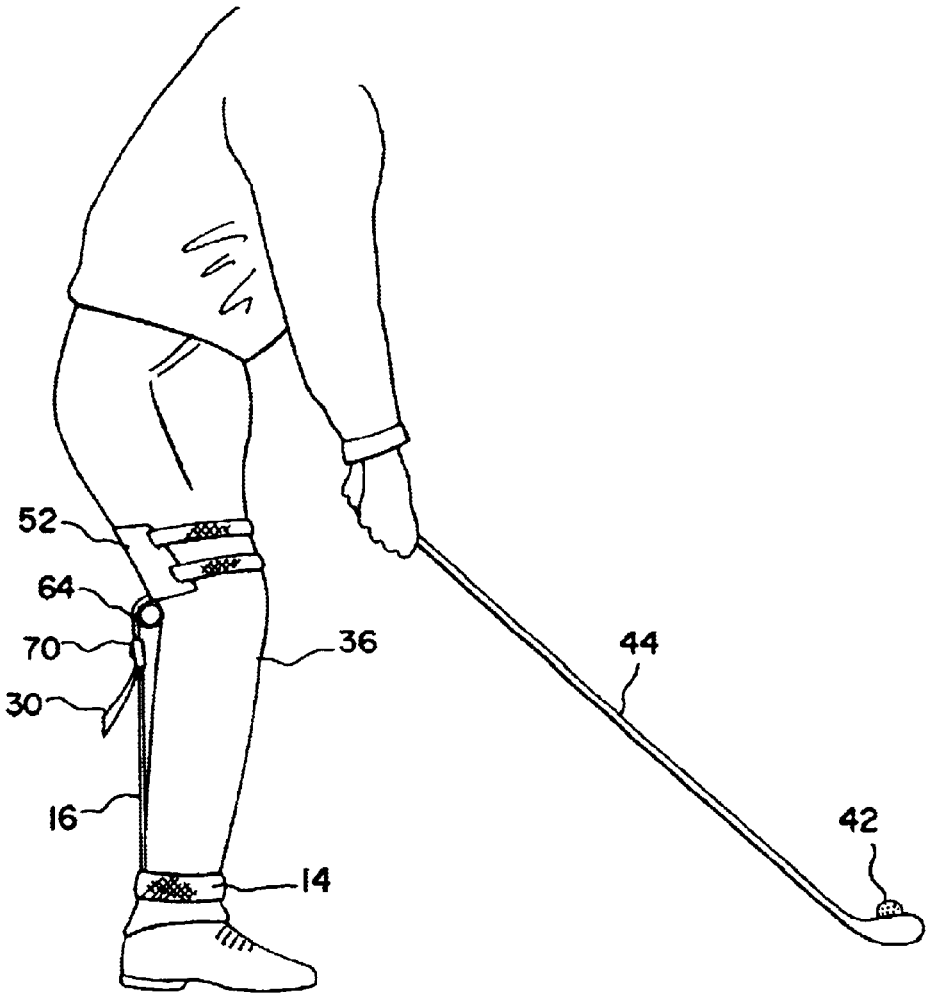

FIGS. 4 to 6 illustrate a second embodiment 50 of the golfer training device according to the present invention. In this embodiment, identical parts have been identified with the same reference numerals as the first embodiment illustrated in FIGS. 1 to 3, and will not be described again in detail here. The principal differences between the present embodiment and the previous embodiment may be found in the upper section of the device 50 and relate mainly to the manner in which the first strap is adapted to be fitted above the knee of the golfer's leg. With the first embodiment of the training device 10, as illustrated in FIGS. 1 to 3, there may be a tendency for the first strap 12 to slip downwards when tension is applied to the third strap 16, particularly if the golfer is wearing pants made from slippery material. The modifications incorporated into the second embodiment of the device 50, are intended to ensure that the first strap is held more securely in place just above the knee of the golfer.

To this end, a first strap 52 of the device 50 is somewhat wider than the first strap 12 of the first embodiment, in order to provide more surface area in contact with the golfer's leg. In the illustrated embodiment, the first strap 52 comprises a wider section 54 of strap to which two narrower straps 56 are stitched. Matching pieces 58, 60 of hook and loop fastener material are provided at respective ends of section 54 and straps 56 to enable the straps 56 to be tightened and held fast about the golfer's leg just above the knee, as can be seen most clearly in FIGS. 5 and 6. Although not apparent in FIG. 1, the two straps 56 are slightly offset with respect to the section 54 to create a tapered or cone-shaped hollow within which the golfer's thigh is comfortably received, as can be seen most clearly in FIG. 6. Alternatively, a single wide strap of similar width to section 54 may be employed to give substantially the same effect.

A further modification incorporated into the device 50 is the provision of securing means 62, which in this embodiment takes the form of a short length of substantially rigid, cylindrical tube 64. The cylindrical tube 64 is suspended just below the first strap 52 and is arranged to rest against the back of the golfer's knee (as can be seen most clearly in FIG. 6). It is attached to the first strap 52 by means of a piece of flexible material 66 which fits around the tube 64 and is stitched onto section 54 of strap 52 at 68. The cylindrical tube 64 may be made from a suitable light-weight metal or plastics material, such as, for example, a short length of PVC tubing. The third strap 16 extends over the tube 64 and runs vertically down the back of the leg as shown in FIG. 5.

The third strap 16 is provided in two elongate portions, each portion having one end fixed to a respective one of the first and second straps, and the respective second ends of the portions being joined by a clasp 70. One portion 72 of the third strap 16 is fixed to the section 54 of the first strap 52 by stitching at 74. The other end is attached to the clasp 70, which is also of the quick-release type.

In this embodiment, the adjusting clasp 70 comes in one piece and has a spring-loaded, pivoting portion 76 which is adapted to grip the strap 16 and prevent from slipping through the clasp 70 when tension is applied thereto. The other portion of the strap 16 is fixed at one end to the second strap 14 by stitching 28, and the other end is fed through the clasp 70 so that a length, hereinafter called the adjusting strap 30, hangs free. When pulling on the adjusting strap 30, strap 16 is pulled through clasp 70 thereby shortening its length. The catch 76 of the clasp 70 will prevent the strap 16 from slipping through as tension is applied to the strap by the golfer's leg. The tension on strap 16 can be released by pressing on the catch 76 so that it pivots and releases its grip on the adjusting strap 30, thereby allowing the golfer to straighten his leg again.

FIG. 5 shows the golf training device 50 fitted to the right leg of a right-handed golfer (for a left-handed golfer, the device will be fitted to the left leg). The first strap 52 is fitted snugly just above the knee 36, and the second strap 14 is fitted just above the ankle 14 and below the calf muscle of the same leg. By pulling down on adjusting strap 30, the length of the third strap 16 may be shortened, causing the leg to bend at the knee 36. The golfer is able to adjust the angle or flex he wishes his knee to maintain during his golf swing because the length of strap 16 determines how much his knee bends.

The purpose of tube 64 behind the knee 36 is to better secure the first strap 52 to the golfer's knee and prevent it slipping down the leg over the knee when adjusting strap 30 is pulled. The function of tube 64 is best illustrated in FIG. 6. Tube 64 sits comfortably against the back of the golfer's knee 36 and helps hold strap 52 securely in place because it causes a degree of horizontal pull on strap 52 when adjusting strap 30 is pulled down. Hence the degree of vertical pull on strap 52 is thereby minimised, and the strap 52 is prevented from slipping down the leg.

In both of the illustrated embodiments, the natural protuberance of the knee 36 also helps to prevent the first strap from slipping downwards over the knee when tension is applied to the third strap. Advantageously, both the first and second straps may be provided with a strip of non-slip material 57 on an inner surface thereof designed to further inhibit slipping of the straps when fastened about the leg. A suitable non-slip material may be rubber, or a synthetic rubberised material such as neoprene, which is used for making wetsuits.

For golfers who do not wish to rely only on physical restraint to prevent their leg from straightening, a pressure sensor (not shown) can be incorporated in the tube 64. When the golfer involuntarily straightens his leg while making a swing with the golfer training device fitted, the pressure exerted by strap 16 on the electronic pressure sensor causes it to emit a sound, warning the golfer that his leg is straightening.

Now that preferred embodiments of the golfer training device have been described in detail, it will be apparent that the device has a number of advantages, including the following:

(i) it is of simple construction and inexpensive to manufacture;

(ii) it is simple to use and easily self-fitted to the golfer's leg;

(iii) it provides an effective means for training a golfer to maintain a desired flex in one leg;

(iv) it is easily adjusted so that the desired flex can be set by the golfer;

(v) it is comfortable to wear and easily removed after use; and, (vi) the tension in the third strap can be quickly released to allow the golfer to straighten his leg and walk normally whilst continuing to wear the device.

Numerous variations and modifications will suggest themselves to persons skilled in the arts relating to golf and sports training aids, in addition to those already described, without departing from the basic inventive concepts. For example, each of the first, second and third straps may be made from leather or any other suitable non-extensible, flexible material. Furthermore, although in both the illustrated embodiments a quick-release clasp is employed to facilitate adjusting the length of the third strap, any other suitable arrangement that facilitates adjustment of the length of the third strap may be employed. For example, hook and loop fastener material could also be employed for adjustably connecting first and second portions of the third strap. It will be understood that the training device of the present invention may have application to other sports where correct knee flexion is required such as, for example, in baseball. All such variations and modifications are to be considered within the scope of the present invention, the nature of which is to be determined from the foregoing description and the appended claims.

What is claimed is:

1. A golfer training device for training a golfer to maintain a desired flex in one leg while swinging a golf club, the device comprising:

a first strap made of substantially inextensible, flexible material and securable to said one leg above the knee of said one leg;

a second strap made of substantially inextensible, flexible material and securable to said one leg below the calf muscle of said one leg;

a third adjustable strap made of substantially inextensible, flexible material joined to and interconnecting said first and second straps and extending, in use, behind the knee and calf muscle of said one leg, the length of said third strap being adjustable to a length such that it causes the knee to flex and remain flexed; and a securing means arranged to rest against the back of the golfer's knee with said third strap extending over said securing means, wherein when said third strap is tensioned, a degree of horizontal pull is applied to said first strap to help hold said first strap securely in place;

wherein said securing means is of cylindrical shape and is attached to said first strap.

2. A golfer training device as defined in claim 1, wherein said first and second straps are adjustable such that they can be tightened and held fast about the leg by means of hook and loop fastener material.

3. A golfer training device as defined in claim 1, wherein said first, second and third straps are made from a non-stretch webbing material.

4. A golfer training device as defined in claim 3, wherein said first and second straps are each provided with a strip of non-slip material on an inner surface thereof to inhibit slipping of the straps when fastened about the leg.

5. A golfer training device as defined in claim 3, wherein said first strap is significantly wider than said second strap and is shaped to be wrapped around a portion of the thigh of said one leg.

6. A golfer training device as defined in claim 1, wherein said third strap is provided in two elongated portions, each portion having one end fixed to a respective one of the first and second straps and the respective second ends of the portions being joined by a clasp.

7. A golfer training device as defined in claim 6, wherein the other end of one of said portions of the third strap passes through the clasp and hangs free, whereby the length of said third strap can be shortened by pulling on said free-hanging other end to tension said third strap.

8. A golfer training device as defined in claim 7, wherein said clasp is of the quick-release type having a releasing means for releasing the tension on said third strap when said releasing means is activated.

* * * * *